United States Patent [19]

Ramm

[11] 4,083,658

[45] Apr. 11, 1978

[54] LIQUID RING COMPRESSOR INCLUDING A CALIBRATED GAS INPUT OPENING

[75] Inventor: Claus Ramm, Nuremberg, Germany

[73] Assignee: Siemens Aktiengesellschaft, Munich, Germany

[21] Appl. No.: 721,450

[22] Filed: Sep. 8, 1976

[51] Int. Cl.[2] ..... F04C 19/00
[52] U.S. Cl. ..... 417/68
[58] Field of Search ..... 417/68, 69, 54, 55, 417/199 A

[56] References Cited

U.S. PATENT DOCUMENTS 3,481,529 12/1969 Mugele ..... 417/69 X

FOREIGN PATENT DOCUMENTS 284,674 6/1914 Germany ..... 417/68
1,068,856 11/1959 Germany ..... 417/69

OTHER PUBLICATIONS

*Br. Chem. Eng., (G.B.),* vol. 16, No. 1, Jan., 1971, p. 37, Green, C.F.A., "Liquid Ring Vacuum Pumps".

*Primary Examiner*—William L. Freeh
*Assistant Examiner*—Edward Look
*Attorney, Agent, or Firm*—Kenyon & Kenyon, Reilly, Carr & Chapin

[57] ABSTRACT

A liquid ring compressor including a separate gas input opening disposed in the control disc of the compressor near the delivery space of the compressor impeller between the suction and the output openings of the control disc. The improvement of the invention comprises the gas input opening comprising a calibrated gas input opening, and the compressor including means for coupling the opening to the compression space of the liquid ring compressor for continuously feeding a pressure-increasing gas ballast to the delivery space of the compressor through the calibrated opening. The pressure increase of the gas pumped by the impeller ahead of the output openings of the control disc in the direction of rotation of the impeller is thereby reduced.

1 Claim, 2 Drawing Figures

LIQUID RING COMPRESSOR INCLUDING A CALIBRATED GAS INPUT OPENING

BACKGROUND OF THE INVENTION

1. Field of the Invention

This invention relates generally to liquid ring compressors, and in particular to an improved liquid ring compressor construction including a calibrated gas input opening for reducing the pressure increase of the gas pumped by the impeller of the compressor ahead of the output openings of the control disc of the compressor in the direction of rotation of the impeller.

2. Description of the Prior Art

Liquid ring compressors including a separate gas input opening in the control disc of the compressor near the delivery space of the impeller between the suction and output openings of the control disc are known in the art. See, for example, German Patent 284,674. In such compressors, the gas input opening is coupled to the atmosphere during starting of the compressor when the suction line thereof is closed. At this point, a very high vacuum is present on the suction side of the compressor and the compression gas is compressed to atmospheric pressure when it reaches the output opening of the compressor. Noise generating turbulence accordingly cannot occur in the liquid ring of the compressor. During normal operation, however, a lower vacuum exists on the suction side of the compressor and the gas pressure exceeds atmospheric pressure within the impeller cell disposed ahead of the gas input opening. A check valve is provided in the compressor behind the opening to prevent gas from escaping from the impeller cell through this opening, thus reducing the output of the compressor, i.e., gas ballast is fed into the compressor impeller only under certain operating conditions.

Low vacuum and high vapor pressure in the liquid ring of the compressor cause vapor bubbles to form within the liquid ring. These vapor bubbles implode at higher pressures, i.e., in the vicinity of the output openings of the compressor, and cause heavy erosion at the adjacent compressor parts. To prevent such cavitation phenomena, limitations must be imposed on the vacuum of the compressor which severely limit the operating range of the compressor. Alternatively, the liquid ring could be formed by a lower vapor pressure liquid, but such a solution is practical, because of process and cost considerations, only in isolated instances.

SUMMARY OF THE INVENTION

It is therefore an object of the present invention to provide an improved liquid ring compressor construction which overcomes the aforementioned disadvantages of heretofore known liquid ring compressors and eliminates the adverse effect of vapor bubbles within the liquid ring of the compressor on the parts of the compressor which are disposed in contact with the liquid ring.

These and other objects of the invention are achieved in a liquid ring compressor including a separate gas input opening disposed in the control disc of the compressor near the delivery space of the compressor impeller between the suction and the output openings of the control disc. The improvement of the invention comprises the opening comprising a calibrated gas input opening, and the compressor including means for coupling the opening to the compression space of the liquid ring compressor for continuously feeding a pressure-increasing gas ballast to the delivery space through the calibrated opening from the compression space of the compressor for reducing the pressure increase of gas pumped by the impeller ahead of the output openings of the control disc in the direction of rotation of the impeller.

The foregoing arrangement prevents cavitation from occurring, since the decrease in the pressure increase in the region of the output openings of the compressor only causes mild implosions to occur near the material surfaces of the compressor. The hard implosions occur in the region of the opening since the liquid ring runs further outside the impeller at that point at a larger and therefore harmless distance from the material surfaces, i.e., the blades, hub, etc. of the compressor.

These and other novel features and details of the invention will be described in further detail in the following detailed description.

DETAILED DESCRIPTION

Figure 1:
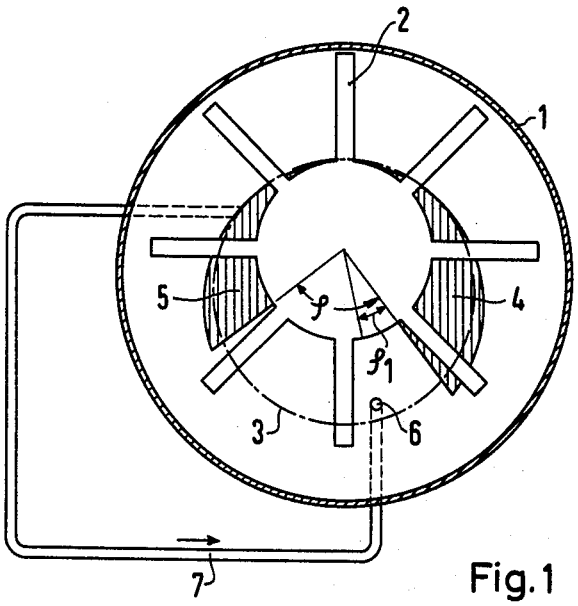
FIG. 1 is a schematic cross-sectional illustration of an improved liquid ring compressor constructed in accordance with the present invention.

Referring now to the drawings, and in particular to FIG. 1, there is shown a liquid ring compressor which includes a cylindrical housing 1 and an impeller 2 mounted eccentrically within the housing. In operation of the compressor, the impeller is eccentrically surrounded by a liquid ring 3 illustrated by the dash-dotted line in the drawings. The compressor includes a delivery space between the impeller and the liquid ring which is defined at the end faces by end walls, one of which comprises the control disc of the compressor and includes a suction opening 4 and an output opening 5. A separate calibrated opening 6 is disposed between suction opening 4 and output opening 5 and is coupled by means of pipeline 7 to the compression space of the compressor which is disposed behind output opening 5.

Figure 2:
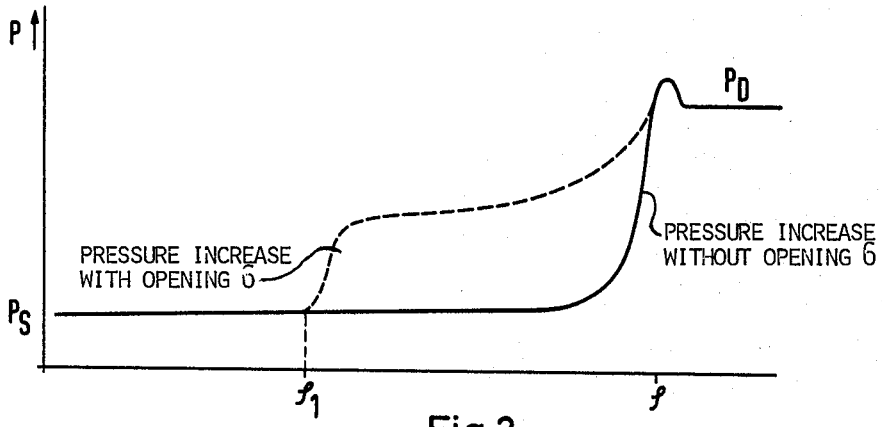
FIG. 2 is a comparative graphical pressure diagram of the pressure increases occurring in a liquid ring compressor constructed according to the present invention and a prior art liquid ring compressor.

FIG. 2 graphically illustrates the pressure increase from $P_S$ to $P_D$ in the region of the angle $\rho$ between the suction and the output openings of the compressor. A liquid ring compressor which is not provided with the calibrated opening 6 has a pressure increase which is illustrated by the solid line in FIG. 2. In contrast, the liquid ring compressor constructed according to the invention with calibrated opening 6 has a pressure increase which is modified as illustrated by the dashed line in FIG. 2. As can be seen from the drawings, the calibrated opening 6 causes the pressure increase, which is sudden and steep in prior art compressors, to be advanced into the region of opening 6, i.e., within the angle $\rho$ between the suction and output openings of the compressor. In this latter area, the liquid ring is disposed further outside the impeller than ahead of the output opening, and the pressure increase is more gradual and smoothed which renders the implosions which occur harmless.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In a liquid ring compressor including a separate gas input opening disposed in a control disc of the compressor near a delivery space of the compressor impeller and between suction and output openings of the control disc, the improvement comprising said opening comprising a calibrated gas input opening, and said compressor including means for coupling said calibrated opening to a compression space of said compressor for continuously feeding a pressure-increasing gas ballast to the delivery space of the compressor through said calibrated opening from the compression space of the compressor for reducing the pressure increase of gas pumped by the impeller ahead of the output openings of the control disc in the direction of rotation of said impeller.

* * * * *